US009911557B2

(12) United States Patent
Vladuchick et al.

(10) Patent No.: US 9,911,557 B2
(45) Date of Patent: Mar. 6, 2018

(54) SF6 INSULTATED CIRCUIT BREAKER SYSTEM WITH HEATER

(71) Applicant: ABB Schweiz AG, Zurich (CH)

(72) Inventors: Paul Vladuchick, Cranberry Township, PA (US); Matt Cuppet, Uniontown, PA (US)

(73) Assignee: ABB Schweiz AG, Baden (CN)

( * ) Notice: Subject to any disclaimer, the term of this patent is extended or adjusted under 35 U.S.C. 154(b) by 0 days.

(21) Appl. No.: 15/194,169

(22) Filed: Jun. 27, 2016

(65) Prior Publication Data

US 2017/0372857 A1 Dec. 28, 2017

(51) Int. Cl.
*H01H 33/64* (2006.01)

(52) U.S. Cl.
CPC ..... *H01H 33/64* (2013.01)

(58) Field of Classification Search
CPC .. H01H 33/56; H01H 33/562; H01H 11/0062; H01H 2011/0068; H01H 3/30
See application file for complete search history.

(56) References Cited

U.S. PATENT DOCUMENTS 3,358,104 A 12/1967 Cromer et al.
3,985,987 A * 10/1976 Patel ..... H01H 33/562 174/11 R
4,024,365 A 5/1977 Soles et al.
4,027,125 A * 5/1977 Peek ..... H01H 3/30 200/308
4,208,556 A * 6/1980 Patel ..... H01H 33/562 218/83
5,128,502 A * 7/1992 Hux ..... H01H 33/008 218/153
5,576,523 A * 11/1996 Meyer ..... H01H 33/022 200/17 R
6,147,333 A 11/2000 Mattson
7,102,101 B1 9/2006 Johnson et al.
8,440,913 B2 * 5/2013 Stull ..... H02B 5/00 174/161 R
9,620,939 B2 * 4/2017 Yeckley ..... H02B 13/00
2007/0080144 A1 * 4/2007 Meyer ..... H01H 33/56 218/97
2009/0045892 A1 * 2/2009 Nelson ..... H02B 5/00 335/202

* cited by examiner

*Primary Examiner* — Truc Nguyen
(74) *Attorney, Agent, or Firm* — Taft Stettinius & Hollister LLP

(57) ABSTRACT

A sulfur hexafluoride (SF6) insulated circuit breaker system having a controller coupled to at least two different sensor devices and operative to control a heat output of an SF6 heater based on signals from the sensor devices. An SF6 insulated circuit breaker system includes a controller coupled to a circuit breaker position indicator and operative to control an SF6 heater based on a signal from the contact position indicator sensor. An SF6 insulated circuit breaker system has a controller coupled to an SF6 density monitor and operative to control an SF6 heater based on a signal from the SF6 density monitor.

20 Claims, 1 Drawing Sheet

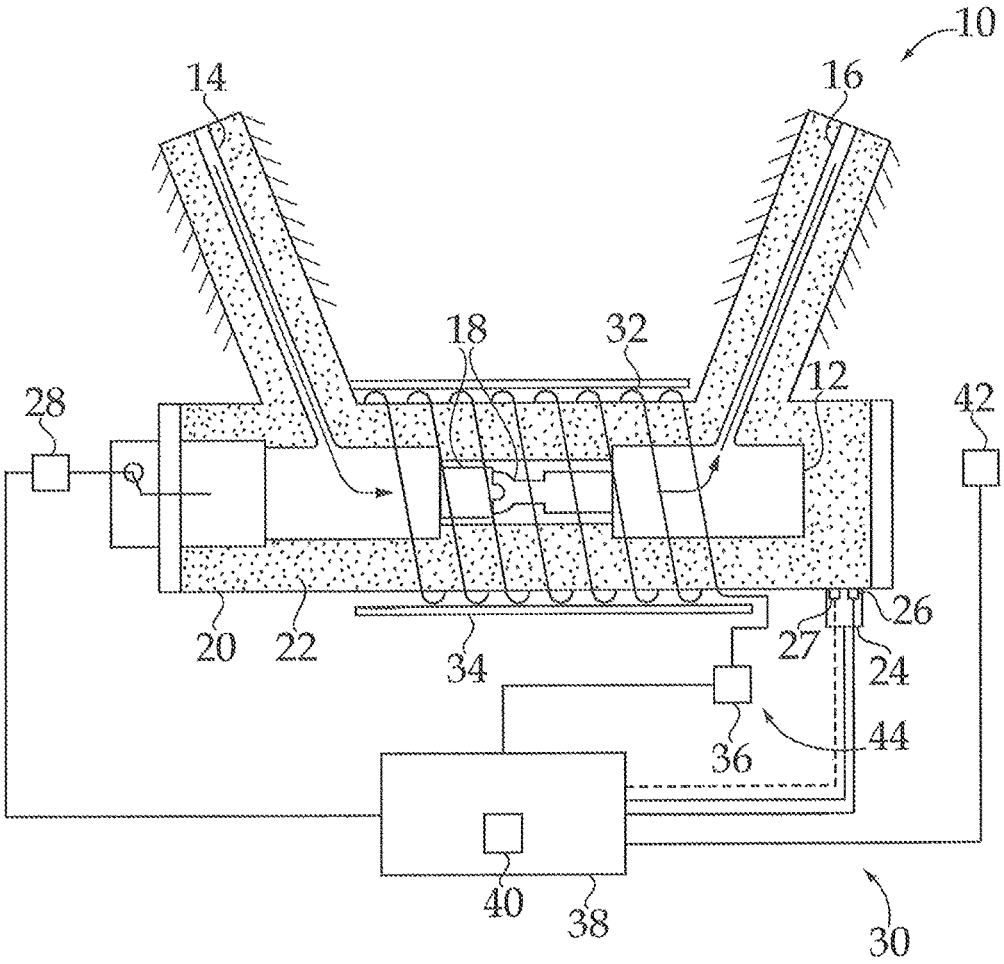
10
14
16
18
32
12
28
42
20
22
34
27
26
24
36
44
40
38
30

SF6 INSULTATED CIRCUIT BREAKER SYSTEM WITH HEATER

TECHNICAL FIELD

The present application generally relates to circuit breakers, and more particularly, but not exclusively, to a sulfur hexafluoride (SF6) insulated circuit breaker system with a heater.

BACKGROUND

Electrical systems of various types, e.g., circuit breaker systems remain an area of interest. Some existing systems have various shortcomings, drawbacks and disadvantages relative to certain applications. For example, in some SF6 insulated circuit breaker systems, the heater for heating the SF6 may have a shorter life than desired, and in some cases may provide excess amounts of heat, which drives up the cost associated with operating the circuit breaker system. Accordingly, there remains a need for further contributions in this area of technology.

SUMMARY

One embodiment of the present invention is a unique sulfur hexafluoride (SF6) insulated circuit breaker system. Other embodiments include other unique SF6 insulated circuit breaker systems. Other embodiments include apparatuses, systems, devices, hardware, methods, and combinations for SF6 insulated circuit breaker systems. Further embodiments, forms, features, aspects, benefits, and advantages of the present application shall become apparent from the description and FIGURE provided herewith.

BRIEF DESCRIPTION OF THE FIGURES

FIG. 1 schematically illustrates some aspects of a non-limiting example of a sulfur hexafluoride (SF6) insulated circuit breaker system in accordance with an embodiment of the present invention.

DETAILED DESCRIPTION OF THE ILLUSTRATIVE EMBODIMENTS

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Referring to FIG. 1, some aspects of a non-limiting example of a sulfur hexafluoride (SF6) insulated circuit breaker system 10 in accordance with an embodiment of the present invention is schematically illustrated. Circuit breaker system 10 is configured to operate at 123-170 kV, although other embodiments may be configured for any voltage range, e.g., up to or greater than 72 kV-800 kV in some embodiments. In one form, circuit breaker system 10 employs an SF6 puffer system to force pressurized SF6 between the circuit breaker contacts during circuit interruption (opening of the contacts). In other embodiments, circuit breaker system 10 may employ any suitable SF6 arc quenching system, e.g., a self-blast system. Circuit breaker system 10 includes a circuit breaker 12 having conductors 14 and 16, contacts 18, a tank 20 functioning as a reservoir to hold a quantity of SF6 22, a density monitor 24 including a temperature sensor 26, a contact position sensor 28, and a heating system 30.

Contacts 18 are constructed to make and break electrical current paths to respectively allow and interrupt current flow through conductors 14 and 16. Contacts 18 are insulated by SF6 from tank 20 for arc quenching. In one form, contacts 18 are double motion contacts. In other embodiments, single motion contacts may be employed. Tank 20 is constructed to store SF6 22, and to act as a reservoir for SF6 22. In the illustrated embodiment, contacts 18 are disposed within tank 20. In other embodiments, contacts 18 may be located outside of tank 20, and may be supplied with SF6 22 from tank 20.

Density monitor 24 is operative to determine and monitor the density of the SF6 gas in tank 20. Under normal conditions, SF6 functions as an electrical insulator, an interrupting media to quench arcing, and a mechanical damper for contacts 18 in circuit breaker 12. The SF6 is stored in tank 20 under pressure at typical temperatures, e.g., room temperature. Under some conditions of low temperature, e.g., −30° C. to −50° C. or lower, the SF6 gas in tank 20 can experience liquefaction, where some of the SF6 gas becomes a liquid, which reduces the density of the gaseous SF6 in the tank that is used to quench arcing, e.g., during the opening of contacts 18. In one form, density monitor 24 employs temperature sensor 26 and a pressure sensor 27 to determine the density of the SF6 gas. In one form, temperature sensor 26 is operative to sense the temperature of the SF6 in tank 20, and to output a signal representative of the temperature. In some embodiments, pressure sensor 27 may also or alternatively be operative to output a signal representative of the pressure of the SF6 in tank 20. In one form, temperature sensor 26 is a thermocouple that senses the temperature of the skin of tank 20. In other embodiments, temperature sensor 26 may be a temperature probe disposed inside tank 20 to sense the temperature of the SF6 is tank 20, or may be another type of sensor device operative to sense the temperature of the SF6 in tank 20.

Density monitor 24 is operative to indicate a state associated with the density of the SF6 gas in tank 20. If the SF6 gas in tank 20 has sufficient density for normal arc quenching operation without undue damage to contacts 18, density monitor 24 outputs a signal indicating a nominal state. If the SF6 gas density is lower than a first predetermined density level, density monitor 24 outputs a signal indicating an alarm state, e.g., to indicate to the operator of circuit breaker system 10 that service is required, e.g., to supply heat to tank 20, although in some cases the alarm state may also be used to indicate the need to replenish the supply of SF6 in tank 20 or take other measures to increase the density of the SF6 in tank 20. If the SF6 gas density drops to a second predetermined density level below that associated with the alarm state, density monitor 24 outputs a signal representing a lockout state. The density levels associated with the nominal state, the alarm state and the lockout state may vary with the needs of the particular application, and are known to those skilled in the art. In some embodiments, when in the lockout state, circuit breaker system 10 allows a single occurrence of a circuit interruption, i.e., allows contacts 18 to be opened a single time, but does not allow contacts 18 to be closed or subsequently closed, or does not allow charging of springs, pistons or other devices used to close contacts 18 until reset of the lockout state. In some embodiments, once in the lockout state, circuit breaker system 10 does not allow either opening or closing of contacts 18 until reset of the lockout state.

Contact position sensor 28 is operative to provide a signal that indicates whether contacts 18 are in the open or closed position. For example, in some embodiments, contact position sensor 28 may be an auxiliary switch that is open when contacts 18 are open, or is closed when contacts 18 are closed. In other embodiments, contact position sensor 28 may take other forms.

Heating system 30 is operative to heat tank 20 in order to achieve and maintain the SF6 gas in tank 20 at or above a desired density value suitable for quenching arcs between contacts 18. Heating system 30 includes one or more heating elements 32, insulation 34, a power supply 36, and a controller 38. In some embodiments, controller 38 includes a timer 40. Some embodiments of heating system 30 may also include an ambient temperature sensor 42. Heating elements 32 and power supply 36 form a heater 44.

Heating elements 32 are disposed about tank 20. In one form, heating elements 32 are ni-chrome ribbon heating elements. In other embodiments, heating elements 32 may take other forms. Insulation 34 is disposed about tank 20 and heating elements 32, and may be, for example, a blanket wrapped around and attached to tank 20, wherein heating elements 32 are disposed between insulation 34 and tank 20. Insulation 34 may take any suitable form. In some embodiments, heating elements 32 may be partially or completely disposed within tank 20. Such embodiments may or may not include insulation 34.

Power supply 36 is coupled to heating elements 32, and is operative to supply power to heating elements 32 for heating tank 20 and the SF6 disposed in tank 20. In one form, power supply 36 is modulatable, that is, power supply 36 is operative to modulate the power supplied to heating elements 32 under the direction of controller 38, rather than simply turn heating elements 32 on and off. In other embodiments, power supply 36 may not be modulatable.

Ambient temperature sensor 42 is operative to sense an ambient temperature in the vicinity of tank 20. For example, in some embodiments, ambient temperature sensor 42 is disposed adjacent to tank 20. Ambient temperature sensor 42 is operative to output a signal representative of the sensed temperature.

In one form, controller 38 is communicatively coupled to density monitor 24, temperature sensor 26, contact position sensor 28, power supply 36 and ambient temperature sensor 42. In some embodiments, controller 38 is communicatively coupled to pressure sensor 27 in addition to or in place of temperature sensor 26. Controller 38 is operative to receive output signals from density monitor 24 indicating the nominal state, the alarm state or the lockout state. Controller 38 is operative to receive signals from temperature sensors 26 and 42 representative of the SF6 temperature in tank 20 and ambient temperature, respectively. Controller 38 is operative to receive a signal from contact position sensor 28 indicating whether contacts 18 are open or closed. Controller 38 is operative to send signals to heater 44, e.g., power supply 36, based on signals received from the sensors 24, 26, 28 and 42, and in some embodiments, sensor 27 in addition to or in place of sensor 26.

In some embodiments, circuit breaker system 10 may include, and controller 38 may be communicatively coupled to, only one or more of density monitor 24, temperature sensor 26, pressure sensor 27, contact position sensor 28, and ambient temperature sensor 42, and controller 38 may be operative to receive signals from respective one or more of density monitor 24, temperature sensor 26, pressure sensor 27, contact position sensor 28, and ambient temperature sensor 42. In such embodiments, controller 38 is operative to control the output of heater 44 based on the received signals.

In some embodiments, controller 38 is operative to modulate the output heater 44. By modulating the power output of heater 44, e.g., between 0% and 100% of maximum power, rather than simply turning heater 44 on at maximum power and then turning it off, the life of heating elements 32 is extended, even if the same or a greater amount of total heating energy is supplied from heating elements 32. For example, a higher number of cycles of expansion and contraction may reduce the life of heating elements 32. In addition, the amount of expansion and corresponding contraction is greater at higher heating element temperatures or heating power output levels, along with concomitant potential damage to the heating elements during and after each cycle. Also, oxidation stress and damage is greater at higher heating element temperatures than at low heating element temperatures. Thus, for example, for a given total heat energy output, heating element usage at 50% of rated heating element 32 maximum power for longer durations may yield better heater element 32 life than a greater number of cycles at 100% power for shorter durations to achieve the same total heat energy output. Accordingly, for situations where less than 100% power is required, the life of heating elements 32 is improved by modulating the output of heater 44, which translates to fewer service calls to the operator of circuit breaker system 10. In addition, the ability to modulate the output of heater 44 means that a lesser amount of heat can be supplied to tank 20 under certain conditions, thus reducing total energy cost associated with circuit breaker system 10.

In one form, controller 38 is operative to modulate the output of heater 44 in increments of 25% power, that is, to selectively provide heater 44 power output at 0%, 25%, 50%, 75% and 100% maximum rated power for elements 32. In other embodiments, other increments may be employed, and in still other embodiments, the modulation may be continuous, e.g., from 0% to 100%. In various embodiments, controller 38 may be operative to modulate the output of heater 44 based on the output signals of any combination of one or more of density monitor 24, temperature sensor 26, pressure sensor 27, contact position sensor 28 and ambient temperature sensor 42.

In some embodiments, controller 38 may be configured to perform calculations necessary to determine the required amount of heating of tank 20. For example, in embodiments equipped with temperature sensor 26, controller 38 may be programmed with the mass of SF6 in tank 20 and the specific heat of the SF6, and may be configured to calculate the amount of heat energy required to heat the SF6 to a desired temperature or to maintain a desired temperature. In other embodiments, the amount of heat energy supplied to the SF6 may be determined based on the SF6 temperature sensed by temperature sensor 26. In some embodiments, using temperature sensor 26 and timer 40, controller 38 may be configured to determine a rate of temperature rise and/or decay of the SF6 based on the amount heat supplied by heater 44, e.g., and based on the ambient temperature measured by ambient temperature sensor 42. Controller 38 may be operative to adjust the heat output of heater 44 in response to: a change in SF6 temperature exceeding or failing to reach a target temperature within a predetermined time period; or a change in SF6 temperature exceeding or failing to reach a target rate of temperature change, e.g., by considering the sensed SF6 temperature over time as measured by timer 40. If the target temperature or rate of temperature change is exceeded, this may indicate the presence of solar heating of tank 20 and/or relatively low wind heat loss conditions. If the target temperature or rate of temperature change is not reached, this may indicate the absence of solar heating and/or the presence of high wind heat loss conditions. In either case, controller 38 is operative to control heater 40 to increase or decrease heater 44 output in order to achieve a target SF6 temperature or a target SF6 rate of change of temperature.

During normal operation, heat is generated within circuit breaker 12 and contacts 18 by the current passing therethrough, coupled with the voltage drop across circuit breaker 12 and contacts 18, i.e., resistance heating. In some embodiments equipped with contact position sensor 28, controller 38 may be operative to control heater 44 to provide a lower heat output if contact position sensor 28 indicates that contacts 18 are closed than if contact position sensor 28 indicates that contacts 18 are open. In some such embodiments, controller 38 is operative to direct heater 44 to increase the heat output in response to contact position sensor 28 indicating that contacts 18 have changed from being closed to being open. The change in heat output may be based, for example, on a lookup table and/or monitoring temperature or temperature rise/decay using timer 42.

In some embodiments, controller 38 may be operative to determine the amount of heat required, e.g., if the temperature of the SF6 is above ambient (assuming a relatively low ambient temperature that requires heating of the SF6 by heater 44), by monitoring the SF6 temperature rise or decay rate using temperature sensor 26, ambient temperature sensor 42, and timer 40, in which case controller 38 may be operative to decrease or increase the output of heater 44 in order to achieve and maintain a desired SF6 temperature without regard to changing conditions, e.g., ambient or environmental conditions, including ambient temperature, solar heating and wind conditions.

As another example, in some situations, contacts 18 may be closed, and may be generating some amount of heat. The temperature sensor 26 and ambient temperature sensor 42 may indicate that the SF6 is several degrees above ambient, and the ambient is low, requiring heating of the SF6. Controller 38 may be configured to calculate the amount of heat being generated by external sources, e.g., solar heating, and by resistance heating of contacts 18 and circuit breaker 12, and, based on the ambient temperature, select an appropriate amount of heat output from heater 44 such that contacts 18 and circuit breaker 12 can operate with sufficient thermal buffer.

In some embodiments, if, after maintaining some desired SF6 temperature, where the SF6 temperature is only a few degrees above a low ambient, and contacts 18 subsequently open, any resistance heating in contacts 18 and circuit breaker 12 is lost (since the flow of current dropped to zero). However, knowing that prior to the opening event, tank 20 was only a few degrees above ambient, controller 38 may be operative to determine that contacts 18 and circuit breaker 12 heating was minimal prior to opening of contacts 18, and may be operative to decide that no additional changes to heater 44 output is required. Alternatively, if the difference between the gas temperature and a low ambient is large, wherein the SF6 temperature is significantly higher than ambient, and contacts 18 are subsequently opened, controller 38 will detect the initial drop in SF6 temperature via temperature sensor 26 and determine that a lot of main circuit heating (resistance heating in circuit breaker 12, including contacts 18) was just lost. It can then quickly ramp up the output of heater 44 to compensate.

In another scenario, if contacts 18 are closed and heater 44 is on (e.g., at some desired heat output value), but the SF6 temperature is significantly less than what was expected, it can be inferred that there is an elevated wind condition. Controller 38 can compensate by directing heater 44 to supply additional heat to create a safety margin, such that if the heater 44 output is cut off due to a loss of substation power, the temperature of the SF6 may be sufficiently high enough to provide a time margin to allow time to bring the substation back on line while still yielding sufficient SF6 density for safe operation of circuit breaker system 10.

In some embodiments, controller 38 is operative to direct heater 44 to provide a higher heat output if density monitor 24 indicates an alarm state or a lockout state than if the SF6 density monitor indicates a nominal state, e.g., in order to return the SF6 to a more desirable density. In some embodiments, controller 38 is operative to direct heater 44 to provide a higher heat output if density monitor 24 indicates a lockout state than if the SF6 density monitor indicates an alarm state, e.g., in order accelerate returning the SF6 to a more desirable density.

Embodiments of the present invention include a sulfur hexafluoride (SF6) insulated circuit breaker system, comprising: a tank constructed to hold a quantity of SF6; a circuit breaker having contacts insulated by the SF6; a heater operative to supply heat to heat the SF6; at least two different sensors selected from the group including: an SF6 temperature sensor operative to sense a temperature of the SF6; an ambient temperature operative to sense an ambient air temperature; a contact position sensor operative to indicate an open or a closed position of the contacts; and an SF6 density monitor operative to indicate a state associated with the density of the SF6 gas in the tank; and a controller coupled to the at least two different sensor devices and operative to control a heat output of the heater based on signals from the at least two different sensor devices.

In a refinement, the at least two different sensors is at least three different sensors selected from the group; and the controller is coupled to the at least three different sensors and operative to control a heat output of the heater based on signals from the at least three different sensors.

In another refinement, the at least two different sensors is the SF6 temperature sensor, the ambient temperature sensor, the contact position sensor, and the SF6 density monitor; and wherein the controller is coupled to the temperature sensor, the ambient temperature sensor, the contact position sensor, and the density monitor, and the controller is operative to control a heat output of the heater based on signals from the SF6 temperature sensor; the ambient temperature sensor; the contact position indicator; and the SF6 density monitor.

In yet another refinement, the controller is operative to modulate the heat output of the heater.

In still another refinement, the controller is operative to modulate the heat output of the heater by selecting a power output of 0%, 25%, 50%, 75% or 100% of maximum heater output.

In yet still another refinement, the at least two input devices includes the contact position indicator; and the controller is operative to control the heater to provide a lower heat output if the contact position sensor indicates that the contacts are closed than if the contact position sensor indicates that the contacts are open.

In a further refinement, the controller is operative to direct the heater to increase the heat output if the contact position sensor indicates that the contacts changed from being closed to being open In a yet further refinement, the at least two different sensor devices include the SF6 density monitor; and the controller is operative to direct the heater to provide a higher heat output if the SF6 density monitor indicates an alarm state than if the SF6 density monitor indicates a nominal state.

In a still further refinement, the at least two different sensor devices include the SF6 density monitor; and the controller is operative to direct the heater to provide a higher heat output if the SF6 density monitor indicates a lockout state than if the SF6 density monitor indicates a nominal state.

In a yet still further refinement, the at least two different sensor devices include the SF6 density monitor; and the controller is operative to direct the heater to provide a higher heat output if the SF6 density monitor indicates a lockout state than if the SF6 density monitor indicates an alarm state.

Embodiments of the present invention include a sulfur hexafluoride (SF6) insulated circuit breaker system, comprising: a tank constructed to hold a quantity of SF6; a circuit breaker having contacts insulated by the SF6; a heater operative to heat the SF6; a contact position sensor operative to indicate an open or a closed position of the contacts; and a controller coupled to the contact position sensor and operative to control the heater based on a signal from the contact position sensor.

In a refinement, the controller is operative to direct the heater to provide a greater heat output if the contacts are in an open position than if the contacts are in a closed position.

In another refinement, the controller is operative to direct the heater to supply heat or to increase the supply of heat to the SF6 if the contacts change from a closed position to an open position.

In yet another refinement, the controller is operative to direct the heater to decrease the supply of heat to the SF6 if the contacts change from an open position to a closed position.

In still another refinement, the controller is operative to modulate the heat output of the heater.

Embodiments of the present invention include a sulfur hexafluoride (SF6) insulated circuit breaker system, comprising: a tank constructed to hold a quantity of SF6; a circuit breaker having contacts insulated by the SF6; a heater operative to heat the SF6; an SF6 density monitor operative to monitor a density of the SF6; and a controller coupled to the SF6 density monitor and operative to control the heater based on a signal from the SF6 density monitor.

In a refinement, the controller is operative to control the heater to provide a lower heat output if the SF6 density monitor indicates a nominal state than if the SF6 density monitor indicates an alarm state.

In another refinement, the controller is operative to control the heater to provide a lower heat output if the SF6 density monitor indicates a nominal state than if the SF6 density monitor indicates a lockout state.

In yet another refinement, the controller is operative to control the heater to provide a lower heat output if the SF6 density monitor indicates an alarm state than if the SF6 density monitor indicates a lockout state.

In still another refinement, the controller is operative to modulate the heat output of the heater.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A sulfur hexafluoride (SF6) insulated circuit breaker system, comprising:

a tank constructed to hold a quantity of SF6;

a circuit breaker having contacts insulated by the SF6;

a heater operative to supply heat to heat the SF6;

at least two different sensors selected from the group including: an SF6 temperature sensor operative to sense a temperature of the SF6; an ambient temperature sensor operative to sense an ambient air temperature; a contact position sensor operative to indicate an open or a closed position of the contacts; and an SF6 density monitor operative to indicate a state associated with the density of the SF6 gas in the tank; and a controller coupled to the at least two different sensors and operative to control a heat output of the heater based on signals from the at least two different sensors.

2. The circuit breaker system of claim 1, further comprising at least one additional different sensor selected from the group; wherein the controller is coupled to the at least two different sensors and the at least one additional different sensor and operative to control a heat output of the heater based on signals from the at least two different sensors and the at least one additional different sensor.

3. The circuit breaker system of claim 1, wherein the at least two different sensors is the SF6 temperature sensor, the ambient temperature sensor, the contact position sensor, and the SF6 density monitor; and wherein the controller is coupled to the temperature sensor, the ambient temperature sensor, the contact position sensor, and the density monitor, and the controller is operative to control a heat output of the heater based on signals from the SF6 temperature sensor; the ambient temperature sensor; the contact position indicator; and the SF6 density monitor.

4. The circuit breaker system of claim 1, wherein the controller is operative to modulate the heat output of the heater between 0% and 100% of maximum power.

5. The circuit breaker system of claim 4, wherein the controller is operative to modulate the heat output of the heater by selecting a power output of 0%, 25%, 50%, 75% or 100% of maximum heater output.

6. The circuit breaker system of claim 1, wherein the at least two different sensors includes the contact position indicator; and wherein the controller is operative to control the heater to provide a first heat output if the contact position sensor indicates that the contacts are closed and a second heat output if the contact position sensor indicates that the contacts are open, wherein the first heat output is less than the second heat output.

7. The circuit breaker system of claim 6, wherein the controller is operative to direct the heater to increase the heat output if the contact position sensor indicates that the contacts changed from being closed to being open.

8. The circuit breaker system of claim 1, wherein the at least two different sensor devices include the SF6 density monitor; and wherein the controller is operative to direct the heater to provide a higher heat output if the SF6 density monitor indicates an alarm state than if the SF6 density monitor indicates a nominal state.

9. The circuit breaker system of claim 1, wherein the at least two different sensor devices include the SF6 density monitor; and wherein the controller is operative to direct the heater to provide a higher heat output if the SF6 density monitor indicates a lockout state than if the SF6 density monitor indicates a nominal state.

10. The circuit breaker system of claim 1, wherein the at least two different sensor devices include the SF6 density monitor; and wherein the controller is operative to direct the heater to provide a higher heat output if the SF6 density monitor indicates a lockout state than if the SF6 density monitor indicates an alarm state.

11. A sulfur hexafluoride (SF6) insulated circuit breaker system, comprising:

a tank constructed to hold a quantity of SF6;

a circuit breaker having contacts insulated by the SF6;

a heater operative to heat the SF6;

a contact position sensor operative to indicate an open or a closed position of the contacts; and a controller coupled to the contact position sensor and operative to control the heater based on a signal from the contact position sensor.

12. The circuit breaker system of claim 11, wherein the controller is operative to direct the heater to provide a greater heat output if the contacts are in an open position than if the contacts are in a closed position.

13. The circuit breaker system of claim 11, wherein the controller is operative to direct the heater to supply heat or to increase the supply of heat to the SF6 if the contacts change from a closed position to an open position.

14. The circuit breaker system of claim 11, wherein the controller is operative to direct the heater to decrease the supply of heat to the SF6 if the contacts change from an open position to a closed position.

15. The circuit breaker system of claim 11, wherein the controller is operative to modulate the heat output of the heater.

16. A sulfur hexafluoride (SF6) insulated circuit breaker system, comprising:

a tank constructed to hold a quantity of SF6;

a circuit breaker having contacts insulated by the SF6;

a heater operative to heat the SF6;

an SF6 density monitor operative to monitor a density of the SF6; and a controller coupled to the SF6 density monitor and operative to control the heater based on a signal from the SF6 density monitor.

17. The circuit breaker system of claim 16, wherein the controller is operative to control the heater to provide a lower heat output if the SF6 density monitor indicates a nominal state than if the SF6 density monitor indicates an alarm state.

18. The circuit breaker system of claim 16, wherein the controller is operative to control the heater to provide a lower heat output if the SF6 density monitor indicates a nominal state than if the SF6 density monitor indicates a lockout state.

19. The circuit breaker system of claim 16, wherein the controller is operative to control the heater to provide a lower heat output if the SF6 density monitor indicates an alarm state than if the SF6 density monitor indicates a lockout state.

20. The circuit breaker system of claim 16, wherein the controller is operative to modulate the heat output of the heater.

* * * * *